US009382635B2

(12) United States Patent
Toi et al.

(10) Patent No.: US 9,382,635 B2
(45) Date of Patent: Jul. 5, 2016

(54) METAL SURFACE TREATMENT AGENT, AND METAL SURFACE TREATMENT METHOD

(71) Applicant: Nippon Paint Surf Chemicals Co., Ltd., Tokyo (JP)

(72) Inventors: Teruzo Toi, Tokyo (JP); Takayuki Ueno, Tokyo (JP)

(73) Assignee: NIPPON PAINT SURF CHEMICALS CO., LTD., Tokyo (JP)

( * ) Notice: Subject to any disclaimer, the term of this patent is extended or adjusted under 35 U.S.C. 154(b) by 0 days.

(21) Appl. No.: 14/899,524

(22) PCT Filed: Mar. 13, 2014

(86) PCT No.: PCT/JP2014/056749
§ 371 (c)(1),
(2) Date: Dec. 17, 2015

(87) PCT Pub. No.: WO2014/156695
PCT Pub. Date: Oct. 2, 2014

(65) Prior Publication Data

US 2016/0145759 A1 May 26, 2016

(30) Foreign Application Priority Data

Mar. 28, 2013 (JP) ..... 2013-070148

(51) Int. Cl.
*C23C 22/34* (2006.01)
*C23C 22/73* (2006.01)
(Continued)

(52) U.S. Cl.
CPC . *C25D 5/36* (2013.01); *C23C 22/06* (2013.01); *C23C 22/82* (2013.01)

(58) Field of Classification Search
CPC ..... C23C 22/34; C23C 22/361; C23C 22/73; C23C 2222/20; C23C 18/28; C09D 5/08
USPC ..... 106/1.11, 14.13, 14.14, 14.15, 14.16, 106/14.17, 14.21; 148/247, 275; 252/389.32, 390, 394
See application file for complete search history.

(56) References Cited

U.S. PATENT DOCUMENTS 7,510,612 B2 * 3/2009 Matsukawa ..... C23C 22/34 106/14.15
7,811,366 B2 * 10/2010 Inbe ..... C23C 22/34 148/247

(Continued)

FOREIGN PATENT DOCUMENTS

EP 2112251 10/2009
JP 2001-329379 11/2001

(Continued)

OTHER PUBLICATIONS

English translation of JP 2006/281710; Oct. 2006; 15 pages.*

*Primary Examiner* — Helene Klemanski
(74) *Attorney, Agent, or Firm* — Knobbe Martens Olson & Bear LLP

(57) ABSTRACT

A metal surface treatment agent and a metal surface treatment which impart excellent electrodeposition coatability (smoothness and throwing power) to a metallic base while heightening corrosion resistance. The metal surface treatment agent that is used in a pretreatment of an electrodeposition coating of a metallic base and includes one or more zirconium, titanium, or hafnium metallic elements, one or more silane coupling agents, hydrolysates thereof, or polymers thereof, and an electrophilic reactive group-containing compound (C) containing a homocycle and a heterocycle in one molecule and has a water solubility at 20° C. of 0.2 to 30 g/L, and the contents of the metallic elements, the coupling agents, and the electrophilic reactive group-containing compound satisfy a given relationship.

8 Claims, 1 Drawing Sheet

(51) Int. Cl.

| | |
|---|---|
| ***C23C 18/28*** | (2006.01) |
| ***C09D 5/08*** | (2006.01) |
| ***C25D 5/36*** | (2006.01) |
| ***C23C 22/06*** | (2006.01) |
| ***C23C 22/82*** | (2006.01) |

(56) References Cited

U.S. PATENT DOCUMENTS

| | | | | |
|---|---|---|---|---|
| 8,075,708 | B2 * | 12/2011 | Matsukawa | C23C 22/34 106/14.15 |
| 2003/0152704 | A1 * | 8/2003 | Haruta | C23C 22/34 106/1.25 |
| 2004/0009300 | A1 * | 1/2004 | Shimakura | C23C 22/34 427/407.1 |
| 2004/0054044 | A1 * | 3/2004 | Bittner | C09D 5/08 524/261 |
| 2004/0187967 | A1 * | 9/2004 | Matsukawa | C23C 22/34 148/247 |
| 2008/0230394 | A1 | 9/2008 | Inbe et al. | |
| 2010/0243465 | A1 * | 9/2010 | Inbe | C23C 22/361 205/184 |
| 2012/0145282 | A1 | 6/2012 | Kodama et al. | |
| 2015/0176136 | A1 * | 6/2015 | Toi | C23C 22/34 148/240 |

FOREIGN PATENT DOCUMENTS

| | | |
|---|---|---|
| JP | 2006/281710 | * 10/2006 |
| JP | 2008-291345 | 12/2008 |
| JP | 2009-084702 | 4/2009 |
| WO | WO 2011/002040 | 1/2011 |
| WO | WO 2013/054905 A1 * | 4/2013 |

* cited by examiner

METAL SURFACE TREATMENT AGENT, AND METAL SURFACE TREATMENT METHOD

This application is the U.S. National Phase under 35 U.S.C. §371 of International Application PCT/JP2014/056749, filed Mar. 13, 2014, designating the U.S., and published in Japanese as WO 2014/156695 on Oct. 2, 2014, which claims priority to Japanese Patent Application No. 2013-070148, filed Mar. 28, 2013, the entire contents of which are incorporated herein by reference.

TECHNICAL FIELD

The present invention relates to a metal surface treatment agent, and a metal surface treatment method.

BACKGROUND ART

Surface treatments have been applied to impart corrosion resistance to various metallic bases. In particular, a zinc phosphate treatment has been generally used as a metallic base in automobile construction. However, this zinc phosphate treatment has a problem such that a large amount of sludge is generated as a by-product. Therefore, there is a demand for a next-generation of surface treatment that does not use zinc phosphate. As one of these, a surface treatment that employs a surface treatment agent that contains zirconium, titanium and hafnium (hereinafter, referred to as "zirconium system surface treatment agent") has been studied.

Incidentally, the metallic base used in automobile construction and is required to have high corrosion resistance is usually subjected to a cationic electrodeposition coating after the surface treatment. As a reason why the cationic electrodeposition coating is employed, in addition to the coating film obtained by the cationic electrodeposition coating being excellent in the corrosion resistance, it is important for the cationic electrodeposition coating to have the property that the coating can be applied to the four corners of an automobile body that has a complicated shape, that is, the cationic electrodeposition coating has so-called "throwing power".

As it is, when the cationic electrodeposition coating is applied to a metallic base that has been surface-treated with the zirconium system surface treatment agent, there are cases where a sufficient effect may not be obtained in the throwing power. Thus, in the case where the cationic electrodeposition coating is applied, when the throwing power is not sufficient, sufficient corrosion resistance is difficult to obtain.

In Patent Document 1, for example, a chemical conversion treatment liquid for metal surfaces, which contains at least one compound selected from an aqueous titanium compound and an aqueous zirconium compound, and an organic compound having a plurality of functional groups as a stabilizer is described, and as the organic compound, for example, a compound having a plurality of carboxylic groups such as lactic acid can be used. However, in Patent Document 1, while the coating adhesiveness between the surface of the metallic base that was treated with the chemical conversion liquid for metallic surface and an electrodeposition coating film and the corrosion resistance are described, the electrodeposition coatability (smoothness and the throwing power) is not described.

In Patent Document 2, a zirconium system surface treatment agent having an electrophilic reactive functional group is described. However, a surface treatment agent described in Patent Document 2 is not a metal surface treatment agent (a so-called "reactive surface treatment agent") of a type in which a film is formed by a pH variation caused by etching on a surface of metallic base but is used as a metal surface treatment agent (so-called "coating type surface treatment agent") of a type in which a film is formed by coating on a surface of metallic base and by drying. Further, in Patent Document 2, since there is no description of the electrodeposition coating of the metallic base that is surface treated with the metal surface treatment agent, it goes without saying that neither the electrodeposition coatability (smoothness and throwing power) is described.

Patent Document 3 describes that excellent throwing power can be developed when the cationic electrodeposition coating is applied to a metallic base that has been surface-treated with a metal surface treatment agent for cationic electrodeposition coating containing zirconium ion and tin ion. Further, in Patent Document 3, there is a description for the effect that benzotriazole may have if added to the metal surface treatment agent for the cationic electrodeposition coating as a rustproof agent. However, the surface treatment agent described in Patent Document 3 may not develop satisfactory throwing power.

Patent Document 1: PCT International Publication No. WO2011/002040

Patent Document 2: Japanese Unexamined Patent Application, Publication No. 2001-329379

Patent Document 3: Japanese Unexamined Patent Application, Publication No. 2008-291345

DISCLOSURE OF THE INVENTION

Problems to be Solved by the Invention

Thus, in its present state a metal surface treatment agent, which is capable of imparting, in addition to sufficient corrosion resistance, excellent electrodeposition coatability to the metallic base is not found.

The present invention is performed to solve the above-described problems and intends to provide a metal surface treatment agent and a metal surface treatment method, which may impart excellent electrodeposition coatability (smoothness and throwing power) while heightening the corrosion resistance of a metallic base.

Means for Solving the Problems

The present inventors have completed the present invention by finding that the above-described object may be achieved when a specific organic compound is contained in the metal surface treatment agent.

In order to achieve the above-described object, the present invention is a metal surface treatment agent for use in the pretreatment of an electrodeposition coating of a metallic base, the agent including one or more metallic elements (A) selected from the group consisting of zirconium, titanium, and hafnium, one or more coupling agents (B) selected from the group consisting of silane coupling agents, hydrolysates thereof, and polymers thereof, and an electrophilic reactive group-containing compound (C), wherein the electrophilic reactive group-containing compound (C) contains a homocycle and a heterocycle in one molecule and has a water solubility at 20° C. of 0.2-30 g/L, and when a content by mass of the metallic elements (A), a content by mass of the coupling agents (B), and a content by mass of the electrophilic reactive group-containing the compound are represented by Wa, Wb, and Wc, respectively, a relationship of the following formula (1) is satisfied.

$$1<(Wb+Wc)/Wa\leq 20 \quad (1)$$

The electrophilic group-containing compound (C) is preferable to be one or more compounds selected from the group consisting of thiazole system compounds, triazole system compounds, pyrazole system compounds and imidazole system compounds.

It is preferable that the content of the metallic elements (A) is 25 to 400 ppm by mass, the content of the coupling agent (B) is 20 to 500 ppm by mass, and the content of the electrophilic reactive group-containing compound (C) is 50 to 400 ppm by mass.

The coupling agent (B) is preferable to be one or more coupling agents selected from the group consisting of amino groups-containing silane coupling agents, epoxy groups-containing silane coupling agents, hydrolysates of the amino groups-containing silane coupling agents, hydrolysates of the epoxy groups-containing silane coupling agents, polymers of the amino groups-containing silane coupling agents and polymers of the epoxy groups-containing silane coupling agents.

The pH of the metal surface treatment agent is preferable to be 3 to 6.

The metallic base preferably contains one or more selected from zinc, iron and aluminum.

Further, the present invention is a surface treatment method that performs a surface treatment of the metallic base containing at least any one of zinc, iron and aluminum, prior to the electrodeposition coating, and includes a surface treatment step for surface treating the metallic base using the metal surface treating agent, and a water washing step for washing the surface-treated metallic base with water.

Still further, the present invention provides a metallic base on which a metal surface treatment film is formed, which is obtained by the metal surface treatment method.

Effects of the Invention

According to the present invention, the metal surface treatment agent and the metal surface treatment method that, while heightening the corrosion resistance of the metallic base, may impart excellent electrodeposition coatability (smoothness and throwing power).

PREFERRED MODE FOR CARRYING OUT THE INVENTION

Figure 1:
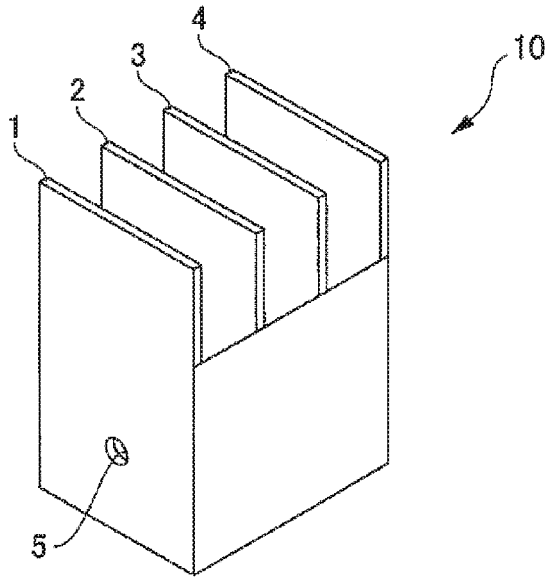
FIG. 1 is a perspective view that shows an example of a box that is used when the throwing power is evaluated.
Figure 2:
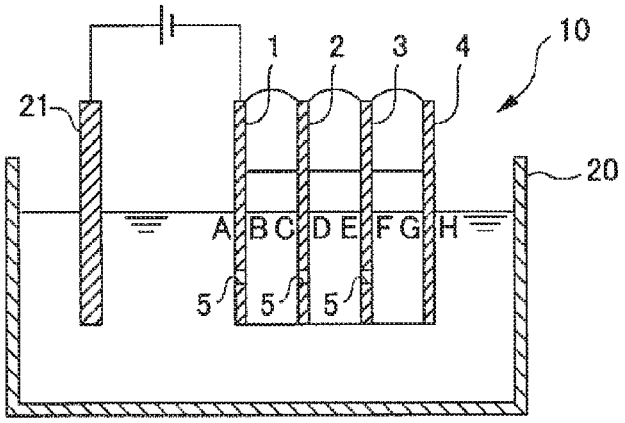
FIG. 2 is a drawing that schematically shows evaluation of the throwing power.

Hereinafter, embodiments of the present invention will be described. The present invention is a metal surface treatment agent that is used in a pretreatment of an electrodeposition coating of a metallic base, the agent including one or more metallic elements (A) selected from the group consisting of zirconium, titanium, and hafnium, one or more coupling agents (B) selected from the group consisting of silane coupling agents, hydrolysates thereof, and polymers thereof, and an electrophilic reactive group-containing compound (C), wherein the electrophilic reactive group-containing compound (C) contains a homocycle and a heterocycle in one molecule and has water solubility at 20° C. of 0.2 to 30 g/L, and when a content of the metallic elements (A) by mass, a content of the coupling agents (B) by mass, and a content of the compound (C) containing an electrophilic reactive group by mass are represented by Wa, Wb, and Wc, respectively, the following relationship (1) is satisfied.

$$1<(Wb+Wc)/Wa\leq 20 \quad (1)$$

Metallic Base

The metal surface treatment agent of the present invention is a metal surface treatment agent for treating a surface of the metallic base. As the metallic base that is surface treated with the metal surface treatment agent of the present invention, a metallic base that contains one or more selected from zinc, iron, and aluminum is preferred. The metallic base that contains one or more selected from zinc, iron, and aluminum may be preferably provided to the cationic electrodeposition coating after the metal surface treatment.

As the metallic base that contains one or more selected from zinc, iron, and aluminum, zinc system bases made of zinc and/or alloys thereof, iron system bases made of iron and/or alloys thereof, and aluminum system bases made of aluminum and/or alloys thereof may be used.

As the metallic base that contains one or more selected from zinc, iron, and aluminum, more specifically, for example, zinc system electroplated steel sheets such as Zn-plated steel sheets, Zn—Ni plated steel sheets, Zn—Fe plated steel sheets, Zn—Cr plated steel sheets, Zn—Al plated steel sheets, Zn—Ti plated steel sheets, Zn—Mg plated steel sheets, and Zn—Mn plated steel sheets, Zn or Zn system alloy plated steel sheets such as hot dipped steel sheets and vacuum deposition plated steel sheets, iron system bases such as cold-rolled steel sheets and hot-rolled steel sheets, and aluminum system bases such as JIS 5000 base aluminum alloy and JIS 6000 base aluminum alloy may be used.

One or More Metallic Elements Selected from the Group Consisting of Zirconium, Titanium and Hafnium (A)

The metal surface treatment agent of the invention contains one or more metallic elements (A) selected from the group consisting of zirconium, titanium and hafnium. The metallic element (A) is a surface film formation component, and when a surface film containing one or more metallic elements selected from the group consisting of zirconium, titanium and hafnium is formed on the metallic base, the corrosion resistance and the wear resistance of the base are improved and further the adhesiveness with the coating film may be heightened.

A supply source of the zirconium is not particularly limited but alkali metal fluorozirconate such as $K_2ZrF_6$, fluorozirconate such as $(NH_4)_2ZrF_6$, fluorozirconate acid such as $H_2ZrF_6$, zirconium fluoride, zirconium oxide, and zirconium nitrate may be used.

A supply source of the titanium is not particularly limited but alkali metal fluorotitanate, fluorotitanate such as $(NH_4)_2TiF_6$, fluorotitanate acid such as $H_2TiF_6$, titanium fluoride, and titanium dioxide may be used.

A supply source of the hafnium is not particularly limited but, for example, fluorohafnate acid such as $H_2HfF_6$, and hafnium fluoride may be used.

The supply sources of the metallic elements (A) may contain fluorine or may be free from fluorine. As the supply sources of the metallic element (A), zirconium fluoride or zirconium nitrate is preferable because of high film-forming ability.

A content of the metallic elements (A) in the metal surface treatment agent of the invention is preferable to be from 25 to 400 ppm by mass and more preferable to be from 50 to 200 ppm by mass. When the content of the metallic elements (A) in the metal surface treatment agent is less than 25 ppm by mass, there is a tendency that the sufficient corrosion resistance may not be obtained because of insufficient precipitation of a film of the metallic elements (A). When the content of the metallic elements (A) in the metal surface treatment agent exceeds 400 ppm by mass, there is a tendency that the sufficient throwing power may not be obtained.

Incidentally, a concentration of the metallic element in the present specification expresses a metallic element equivalent concentration by paying attention only to the metallic element in the complex or oxide when the complex or the oxide is formed. For example, a metallic element equivalent concentration of zirconium of 100 ppm by mass of a complex ion $ZrF_6^{2-}$ (molecular weight: 205) is calculated to be 44 ppm by mass from the calculation of 100×(91/205).

Further, the metal surface treatment agent of the invention is preferred not to contain tin. When the metal surface treatment agent does not contain tin, excellent corrosion resistance may be imparted to the metallic base.

Incidentally, the metal surface treatment agent "does not contain tin" does not mean that the metal surface treatment agent that slightly contains tin as an impurity of the component be removed from the invention. Specifically, the metal surface treatment agent that "does not contain tin" is a metal surface treatment agent in which the content of the tin element is less than 1 ppm by mass.

One or More Coupling Agents (B) Selected from the Group Consisting of Silane Coupling Agents, Hydrolysates Thereof and Polymers Thereof The metal surface treatment agent of the invention contains one or more coupling agents (B) selected from the group consisting of silane coupling agents, hydrolysates thereof and polymers thereof. The silane coupling agent is a compound that has a siloxane bond. For the (B) component, one or more coupling agents selected from the group consisting of amino group-containing silane coupling agents that have at least one amino group in the molecule, epoxy group-containing silane coupling agents that contain at least one epoxy group in the molecule, hydrolysates of the amino group-containing silane coupling agents, hydrolysates of the epoxy group-containing silane coupling agents, polymers of the amino group-containing silane coupling agents and polymers of the epoxy group-containing silane coupling agents may be preferably used, because the adhesiveness between the metallic base and a film and between the film and the coating film is improved and the corrosion resistance of the metallic base on which the coating film is formed is improved.

An effect like this is inferred to occur such that a group that generates silanol by hydrolysis is hydrolyzed and a hydrogen bond is absorbed on a surface of the metallic base, and, the amino group or the epoxy group condenses with a surface film such as zirconium. That is, it is considered that when the amino group-containing silane coupling agent, the epoxy group-containing silane coupling agent, the hydrolysate of the amino group-containing silane coupling agent, the hydrolysate of the epoxy group-containing silane coupling agent, the polymer of the amino group-containing silane coupling agent or the polymer of the epoxy group-containing silane coupling agent works on both the metallic base and the coating film, it is an action that improves the mutual adhesiveness is generated.

The amino group-containing silane coupling agent is not particularly limited and the known silane coupling agents such as N-2(aminoethyl)3-aminopropylmethyldimethoxysilane, N-2(aminoethyl)3-aminopropyltrimethoxysilane, N-2(aminoethyl)3-aminopropyltriethoxysilane, 3-aminopropyltrimethoxysilane, 3-aminopropyltriethoxysilane, 3-triethoxysilyl-N-(1,3-dimethyl-butylidene)propylamine, and N-phenyl-3-aminopropyltrimethoxysilane, N,N-bis[3-(trimethoxysilyl)propyl]ethylenediamine may be used. Also commercially available amino group-containing silane coupling agents such as KBM-602, KBM-603, KBE-603, KBM-903, KBE-9103, KBM-573 (all are manufactured by Shin-Etsu Chemical Co., Ltd.) and XS1003 (manufactured by Chisso Corporation) may be used.

The hydrolysates of the amino group-containing silane coupling agents may be produced according to a conventional methods, for example, a method in which the amino group-containing silane coupling agent is dissolved in ion-exchanged water and an arbitrary acid is added to adjust the acidity. As the hydrolysate of the amino group-containing silane coupling agent, also commercially available products such as KBP-90 (manufactured by Shin-Etsu Chemical Co., Ltd.: effective component 32%) may be used.

The polymer of the amino group-containing silane coupling agent is not particularly limited and commercially available products such as Sila-Ace S-330 (γ-aminopropyltriethoxysilane; manufactured by Chisso Corporation), Sila-Ace S-320(N-(2-aminoethyl)-3-aminopropyltrimethoxysilane; manufactured by Chisso Corporation) may be used.

Further, the epoxy group-containing silane coupling agent is not particularly limited and, for example, 3-glycidoxypropyltrimethoxysilane, 3-glycidoxypropyltriethoxysilane, 3-glycidoxypropylmethyldimethoxysilane, 3-glycidoxypropylmethyldiethoxysilane, 3-glycidoxypropyldiethylethoxysilane, 2-(3, 4-epoxycyclohexyl)ethyltrimethoxysilane, 2-(3, 4-epoxycyclohexyl)ethyltriethoxysilane, and 5, 6-epoxyhexyltriethoxysilane may be used. Also commercially available "KBM-403", "KBE-403", "KBE-402" and "KBM-303" (all are manufactured by Shin-Etsu Chemical Co. Ltd.) may be used.

The hydrolysates of the epoxy group-containing silane coupling agents may be produced according to a conventional method, for example, a method in which the epoxy group-containing silane coupling agent is dissolved in ion-exchanged water and an arbitrary acid is added to adjust the acidity. Also the polymer of the epoxy group-containing silane coupling agent is not particularly limited.

The content of the coupling agent (B) in the metal surface treatment agent of the invention is preferable to be 20 to 500 ppm by mass and more preferable to be 100 to 400 ppm by mass. When the content of the (B) component in the metal surface treatment agent is less than 20 ppm by mass, there is a tendency that the sufficient coating film adhesiveness and corrosion resistance may not be obtained. When the content of the (B) component in the metal surface treatment agent exceeds 500 ppm by mass, there is a tendency that the sufficient effect may not be obtained in both the corrosion resistance and the electrodeposition coatability. The content of the coupling agent (B) means a mass as a solid content of the coupling agent (B) relative to a mass of the metal surface treatment agent as a whole.

Electrophilic Reactive Group-Containing Compound (C)

The metal surface treatment agent of the invention includes an electrophilic reactive group-containing compound (C).

The electrophilic reactive group-containing compound (C) contains a homocycle and a heterocycle in one molecule and has a water solubility at 20° C. of 0.2 to 30 g/L. When the water solubility of the electrophilic reactive group-containing compound (C) is less than 0.2 g/L, the solubility to the metal surface treatment agent may not be sufficiently maintained and the electrophilic reactive group-containing compound (C) precipitates with time. Further, when the water solubility of the electrophilic reactive group-containing compound (C) exceeds 30 g/L, the water affinity of the film formed after the metal surface treatment becomes higher, and the electrodeposition coatability (smoothness and throwing power) is degraded. The metallic base with its surface treated with the metal surface treatment agent that contains the electrophilic reactive group-containing compound (C) has excellent electrodeposition coatability (smoothness and throwing power). The electrophilic reactive group-containing compound (C) is preferable to have the water solubility at 20° C. of 0.5 to 28 g/L.

The compound that contains a homocycle and a heterocycle in one molecule is a compound that has at least one or more homocycles and heterocycles in one molecule. The homocycle and heterocycle in one molecule may share two atoms on the ring (condensed ring structure), may share three or more atoms (cross-linked structure), or may not share an atom.

For the electrophilic reactive group-containing compound (C), thiazole system compounds, triazole system compounds, pyrazole system compounds and imidazole system compounds may be used. The electrophilic reactive group-containing compound (C) is preferable to be one or more compounds selected from the group consisting of the thiazole system compounds, triazole system compounds, pyrazole system compounds and imidazole system compounds.

The thiazole system compound is a compound having a thiazole structure, and for the thiazole system electrophilic reactive group-containing compound (C), benzothiazole (water solubility at 20° C.: 0.2 g/L) and mercaptobenzothiazole (water solubility at 20° C.: 0.9 g/L) may be used.

The triazole system compound is a compound that has a triazole structure, and, for the triazole system electrophilic reactive group-containing compound, benzotriazole (water solubility at 20° C.: 25 g/L) and 5-methyl-1H-benzotriazole (water solubility at 20° C.: 6 g/L) may be used.

The pyrazole system compound is a compound having a pyrazole structure.

The imidazole system compound is a compound that has an imidazole structure, and, for the imidazole system electrophilic reactive group-containing compound (C), aminobenzimidazole (water solubility at 20° C.: 1 g/L) may be used.

These electrophilic reactive group-containing compounds (C) may be used singularly or in a mixture of a plurality of types.

The reason why the metallic base with its surface treated with the metal surface treatment agent containing the electrophilic reactive group-containing compound (C) exhibits excellent electrodeposition coatability (smoothness and throwing power) is considered to be that when the heterocycle having the electrophilic reactivity coordinates to a surface of the metallic base and a homocycle having high hydrophobic property is disposed on a surface of a film on which the electrodeposition coating of the metallic surface is applied, water is effectively removed from the surface of the metallic base during the electrodeposition coating.

The content of the electrophilic reactive group-containing compound (C) in the metal surface treatment agent of the invention is preferable to be 50 to 400 ppm by mass and more preferable to be 100 to 300 ppm by mass. When the content of the (C) component in the metal surface treatment agent is less than 50 ppm by mass, there is a tendency that the smoothness is degraded when the electrodeposition coating is applied on the metallic base of which surface is treated with the metal surface treatment agent. When the content of the (C) component in the metal surface treatment agent exceeds 400 ppm by mass, there is a tendency that the corrosion resistance is degraded.

The metal surface treatment agent of the invention satisfies a relationship of the following formula (1) when a content of the metallic elements (A) by mass, a content of the coupling agent (B) by mass, and a content of the electrophilic reactive group-containing compound (C) by mass are represented by Wa, Wb, and Wc, respectively.

$$1<(Wb+Wc)/Wa\leq 20 \quad (1)$$

The above-described formula (1) defines a numerical value obtained by dividing a total content by mass of the coupling agent (B) and the electrophilic reactive group-containing compound (C) by the content of the metallic elements (A) by mass and is regulated to be larger than 1 and 20 or less. The metallic base that is treated with the metal surface treatment agent having the numerical value of 1 or less may not obtain sufficient electrodeposition coatability (smoothness and throwing power), and the surface of the metallic base that is treated with the metal surface treatment agent having the numerical value of more than 20 is low in corrosion resistance. The numerical value obtained by dividing a total content by mass of the coupling agent (B) and the electrophilic reactive group-containing compound (C) by the content of the metallic elements (A) by mass is preferable to be larger than 2 and 16 or less. The numerical value obtained by dividing the total content by mass of the coupling agent (B) and the electrophilic reactive group-containing compound (C) by the content of the metallic elements (A) by mass is more preferable to be larger than 4 and 12 or less.

The pH of the metal surface treatment agent of the invention is preferable to be in the range of from 3 to 6. When the pH of the metal surface treatment agent is less than 3, the above-described metallic elements (A) are present in a stable state in the metal surface treatment agent. Therefore, there is a tendency that these metallic elements are difficult to precipitate and a sufficient film may not be formed. On the contrary, when the pH of the metal surface treatment agent exceeds 6, the etching of the metal surface does not proceed, and there is also a tendency that a sufficient film may not be formed. The pH of the metal surface treatment agent is preferable to be in the range of from 3.5 to 5. Acidic compounds such as nitric acid and sulfuric acid and basic compounds such as sodium hydroxide, potassium hydroxide and ammonia may be used to adjust the pH of the metal surface treatment agent.

The metal surface treatment agent of the invention may further contain at least one metallic element selected from the group consisting of magnesium, zinc, calcium, aluminum, gallium, indium and copper as an adhesiveness and corrosion resistance imparting agent. When the above-described adhesiveness and corrosion resistance imparting agent is contained, a chemical conversion film having more excellent adhesiveness and corrosion resistance may be obtained.

When the metal surface treatment agent of the invention contains at least one metallic element selected from the group consisting of magnesium, zinc, calcium, aluminum, gallium, indium and copper, which are described above, the content of the metallic element is preferable to be in the range of from 1 to 2000 ppm by mass and more preferable to be in the range of from 25 to 1000 ppm by mass. When the content of these metallic elements is less than 1 ppm by mass, a sufficient effect of the adhesiveness and corrosion resistance may not be obtained. When the content of these metallic elements exceeds 2000 ppm by mass, the adhesiveness after the coating may decrease.

The metal surface treatment agent of the invention may contain, other than the above-described components, an arbitrary component, as required.

Metal Surface Treatment Method

A metal surface treatment method of the invention is a surface treatment method in which a metallic base containing one or more selected from zinc, iron and aluminum is surface treated before the electrodeposition coating, and includes a surface treatment step in which the metallic base is surface treated with the metal surface treatment agent, and a water washing step in which the metallic base on which the surface treatment was applied is washed with water.

Before applying the surface treatment step in the metal surface treatment method of the invention, it is preferable to apply a degreasing step to a surface of the metallic base and a step of water washing after the degreasing. The degreasing step is performed to remove oil and dirt attached onto the surface of the base and a dipping treatment is performed with a degreasing agent such as a phosphorus-free and nitrogen-free degreasing liquid for about several minutes usually at 30 to 55° C. As desired, prior to the degreasing step, a preliminary degreasing step may be performed.

The step of water washing after the degreasing step is performed by carrying out a step of spraying a huge amount of washing water one or more times to wash a degreasing agent after the degreasing step with water.

The condition of the surface treatment step in the metal surface treatment method of the invention is not particularly limited, and may be performed by bringing the metal surface treatment agent and the surface of the metallic base into contact under the normal treatment condition. The treatment temperature in the surface treatment step is preferable to in the range of from 20 to 70° C. and more preferable to be in the range of from 30 to 50° C. The surface treatment time in the surface treatment step is preferable to be in the range of from 5 to 1200 seconds and more preferable to be in the range of from 30 to 120 seconds. A method by which the metal surface treatment agent and the surface of the metallic base are brought into contact is not particularly limited and, for example, a dipping method, a spraying method, a roll coating method, and a flow mechanism approach may be used.

Incidentally, the metal surface treatment agent that is used in the surface treatment step in the metal surface treatment method of the invention is preferable to be a reactive metal surface treatment agent for pH from 3 to 6. By using the reactive metal surface treatment agent, when the surface of the metallic base is surface treated, a pH change (increase) occurs due to an etching reaction in the vicinity of the surface, a component (the above-described (A) component) to be a surface treatment film precipitates and a metal surface treatment film is formed. When the pH of the metal surface treatment agent is less than 3, the metallic elements (A) are stably present in the metal surface treatment agent. Therefore, these metallic elements are difficult to precipitate and there is a tendency that such a film may not be sufficiently formed. On the contrary, when the pH of the metal surface treatment agent exceeds 6, the etching of the metal surface does not proceed, and there is also a tendency that such a film may not be sufficiently formed.

Further, the step of water washing in the metal surface treatment method of the invention is performed by carrying out the step of water washing one or more times such that by rinsing away the components of the metal surface treatment agent, which are not precipitated on the surface of the metallic base, an adverse effect may not be applied on the adhesiveness and corrosion resistance after the following various coatings. In this case, the last water washing is preferable to be performed with pure water. In the step of water washing after the metal surface treatment, any one of spray water washing and dip water washing may be used, or a combination of these washings may be used to wash with water.

After the water washing after the metal surface treatment, according to a well-known method, as required drying is applied, and, after that, various coatings may be applied.

The metallic base on which a metal surface treatment film was formed of the invention is obtained according to the metal surface treatment method described above.

On the surface of the metallic base, a metal surface film containing the metallic elements (A), the coupling agent (B), and the electrophilic reactive group-containing compound (C) is formed.

The content of the metallic elements (A) in the metal surface film is preferable to be 20 to 100 mg/m$^2$ and more preferable to be 30 to 70 mg/m$^2$. When the content of the (A) component in the metal surface film is less than 20 mg/m$^2$, there is a tendency that sufficient corrosion resistance may not be obtained. When the content of the (A) component in the metal surface film exceeds 100 mg/m$^2$, there is a tendency that the smoothness and throwing power may be degraded.

The content of a silicon (Si) element in the metal surface film is preferable to be in the range of from 1 to 10 mg/m$^2$ and more preferable to be in the range of from 2 to 5 mg/m$^2$. When the content of the silicon (Si) element in the metal surface film is less than 1 mg/m$^2$ or exceeds 10 mg/m$^2$, there is a tendency that sufficient corrosion resistance and electrodeposition coatability may not be obtained. The silicon (Si) element in the metal surface film is derived from the coupling agent (B).

The content of carbon element in the metal surface film is preferable to be from 2 to 12 mg/m$^2$ and more preferable to be from 4 to 7 mg/m$^2$. When the content of the carbon element in the metal surface film is less than 2 mg/m$^2$, there is a tendency that the electrodeposition coatability may degrade, and when exceeding 12 mg/m$^2$, there is a tendency that the corrosion resistance may degrade. The carbon element in the metal surface film is mainly derived from the coupling agent (B) and the electrophilic reactive group-containing compound (C).

A ratio of the content of silicon (Si) relative to the content of the metallic elements (A) (the content of silicon (Si)/the content of one or more metallic elements (A) selected from the group consisting of zirconium, titanium and hafnium) in the metal surface film is preferable to be from 2 to 12% and more preferable to be from 5 to 10%. When the ratio of the content of silicon (Si) relative to the content of the metallic elements (A) in the metal surface film is less than 2%, there is a tendency that the corrosion resistance may degrade because the adhesiveness between the surface of the metallic base and the metal surface film degrade, and, when exceeding 12%, there is a tendency that the corrosion resistance also degrades because an amount of the (A) component in the metal surface film relatively decreases. These contents are based on mass.

Electrodeposition Coating

An electrodeposition coating that may be applied on the metallic base on which the metal surface treatment film of the invention is formed is not particularly limited, but a cationic electrodeposition coating is preferable to be performed.

The cationic electrodeposition coating described above is performed in such a manner that the metallic base on which the surface treatment and the water washing were performed is immersed in a cationic electrodeposition paint, and, with this as a cathode, a voltage of 50 to 450 V is applied for a predetermined time. The application time of the voltage is generally 2 to 4 minutes though different depending on the electrodeposition condition.

As the cationic electrodeposition paint, generally known ones may be used. Specifically, a paint is generally obtained in such a manner that a binder that is cationized by attaching amine or sulfide to an epoxy group that an epoxy resin or an acrylic resin has and by adding a neutralizing acid such as acetic acid, block isocyanate as a curing agent, and a pigment dispersed paste in which a rust preventive pigment is dispersed in a resin are added to form a paint.

After the end of the cationic electrodeposition coating step, as it is, or after washing with water, the baking is applied at a predetermined temperature to obtain a cured coating film. The condition of the baking is, though different depending on the type of the cationic electrodeposition paint that was used, preferable to be 140 to 220° C. The baking time may be set to 10 to 30 minutes.

EXAMPLES

According to the following Examples, the invention will be described in more detail. However, the invention is not limited to these. Unless otherwise noted, "parts" and "%" in Examples are based on mass.

Preparation of Metal Surface Treatment Agent

According to a well-known preparation method, the respective components were compounded and mixed such that contents of zirconium and titanium of the metal surface treatment agent, the silane coupling agent, the organic compound (benzotriazole, mercaptobenzothiazole, benzothiazole, triazole, thiazole, carbazole), other compound and other metallic ion may be as shown in Table 1, Table 2 and Table 3, and were further diluted with water, and the metal surface treatment agents of Examples 1 to 52 and Comparative Example 1 to 16 were prepared (unit of numerical values in the tables is ppm by mass). As the supply source of zirconium, zirconium fluoride or zirconium nitrate was used (the metal surface treatment agents of Comparative Examples 3 and 11 do not contain zirconium). As the supply source of titanium, hexafluorotitanic acid was used. As the silane coupling agent, an amino group-containing silane coupling agent (KBM-603: N-2-aminoethyl-3-aminopropyltrimethoxysilane: effective concentration 100%: manufactured by Shin-Etsu Chemical Co., Ltd.) or an epoxy group-containing silane coupling agent (KBM-403: 3-glycidoxypropyltrimethoxysilane: effective concentration 100%: manufactured by Shin-Etsu Chemical Co., Ltd.) were used (the metal surface treatment agents of Comparative Examples 1 and 9 do not contain the silane coupling agent). Further, in Examples 11 and 12, zinc nitrate was added as a zinc ion source, in Example 13, aluminum nitrate was added as an aluminum ion source, in Example 14, calcium nitrate was added as a calcium ion source, and in Comparative Examples 7 and 15, magnesium nitrate was added as a magnesium source. In each of the metal surface treatment agents, the pH was adjusted to be 4.0 using nitric acid or sodium hydroxide. Incidentally, "(Wb+Wc)/Wa" in Table 1, Table 2, and Table 3 is a numerical value obtained by dividing a total content by mass of the coupling agent (B) and the electrophilic reactive group-containing compound (C) by the content by mass of the metallic elements (A) in the metal surface treatment agent.

Surface Treatment

As the metallic base, in Examples 1 to 24, and Comparative Examples 1 to 8, a commercially available cold-rolled steel sheet (SPC, manufactured by Nippon Testpanel Co., Ltd., 70 mm×150 mm×0.8 mm) was prepared, in Examples 25 to 42, and Comparative Examples 9 to 16, an alloyed hot dip galvanized steel sheet (GA, manufactured by Nippon Steel and Sumitomo Metal Corporation, 70 mm×150 mm×0.8 mm) was prepared, and in Examples 43 to 52, an aluminum steel sheet (A6022, 70 mm×150 mm×0.8 mm) was prepared. These steel sheets were subjected to a degreasing treatment at 40° C. for two minutes using "Surfcleaner EC 92" (manufactured by Nippon Paint Co., Ltd.) as an alkaline degreasing agent. These were washed by dipping in a water washing bath, followed by washing by spraying tap water for about 30 seconds.

The degreased metallic bases were subjected to the surface treatment by immersing in the metal surface treatment liquids prepared in Examples and Comparative Examples at 40° C. for 90 seconds. After the end of the surface treatment, water washing was applied, followed by drying at 40° C. for more than 5 minutes, and a surface treated metallic base was obtained. Unless otherwise noted, in the following evaluations, these surface treated metallic bases were used as a test sheet.

Measurement of Element Content in Metal Surface Film

The content (mg/m$^2$) of each element (zirconium (Zr), titanium (Ti), silicon (Si), carbon (C)) contained in the metal surface film was measured with a X-ray fluorescence spectrometer "XRF1700" (manufactured by Shimadzu Corporation). Measurement results are shown in Table 1, Table 2 and Table 3.

Evaluation of Bath Stability

The metal surface treatment liquids prepared according to examples and comparative examples were left at rest at 40° C., and, after the passage of 10 days, were visually evaluated according to the following evaluation criteria. Results of evaluation are shown in Table 1, Table 2 and Table 3.

P: no precipitation

F: precipitation

Evaluation of Throwing Power (Th-P Property)

The throwing power was evaluated according to a "four-sheet box method" described in JP2000-038525 A. That is, as shown in FIG. 1, test sheets 1 to 4 were, in an erected state, disposed in parallel at a separation of 20 mm, lower parts of both side surfaces and a bottom surface were sealed with an insulator such as a cloth adhesive tape, and a box 10 was prepared. Incidentally, in metal materials 1, 2 and 3 excluding the metal material 4, at a lower part, through hole 5 having a diameter of 8 mm was disposed.

The box 10 was immersed in an electrodeposition coating vessel 20 that was filled with a cationic electrodeposition paint "Power Knicks 310" (manufactured by Nippon Paint Co., Ltd.). In this case, from only each through hole 5, the cationic electrodeposition paint intrudes into the inside of the box 10.

While stirring the cationic electrodeposition paint with a magnetic stirrer, the respective test sheets 1 to 4 were electrically connected, and a counter electrode 21 was disposed such that the distance from the test sheet 1 was 150 mm. With each of the test sheets 1 to 4 as a cathode, and with the counter electrode 21 as an anode, a voltage was applied, and the cationic electrodeposition coating was performed. The coating was performed in such a manner that the voltage was raised up to a target voltage (180 V) over 30 seconds from the application start and, after that, the voltage was maintained for 150 seconds. The bath temperature at this time was controlled to 30° C.

Each of the coated test sheets 1 to 4 was, after washing with water, heated at 170° C. for 25 minutes, cooled in air, a film thickness of the coating film formed on surface A of the test sheet 1 closest to the counter electrode 21 and the film thickness of the coating film formed on surface G of the test sheet 4 furthest from the counter electrode 21 were measured, and the throwing power was evaluated by obtaining a ratio of the film thickness (G surface)/film thickness (A surface). Results of evaluation are shown in Table 1, Table 2 and Table 3. It can be evaluated that the larger the value is, the better the throwing power is. An acceptable level is 40% or more.

Evaluation of Smoothness

After a 15 μm electrodeposition coating film was formed on the test sheet using a cationic electrodeposition paint "Power Knicks 310" (manufactured by Nippon Paint Co., Ltd.), the surface roughness (Ra) was measured and evaluated based on the following evaluation criteria. Results of evaluation are shown in Table 1, Table 2 and Table 3. When the surface roughness (Ra) is 0.25 μm or less, the smoothness satisfies the acceptable level.

A: Ra≤0.20 μm

B: 0.20 μm<Ra≤0.25 μm

C: 0.25 μm<Ra≤0.30 μm

D: 0.30 μm<Ra

Evaluation of SST Performance (Salt Spray Test)

After a 20 μm electrodeposition coating film was formed on the test sheet using the cationic electrodeposition paint "Power Knicks 310" (manufactured by Nippon Paint Co., Ltd.), an edge and a back surface were sealed with a tape, and a cross cut scratch reaching a metallic substrate was formed. This was subjected for 1000 hours to a continuous spray of a 5% aqueous solution of sodium chloride held at 35° C. in a salt spray testing instrument held at 35° C. and 95% humidity. Next, after water washing and drying in air, an adhesive tape "Erupakku LP-24" (manufactured by Nichiban Co., Ltd.) was brought into close contact, and the adhesive tape was rapidly peeled. A magnitude of the largest width (one side) of the coating film adhered to the peeled adhesive tape was measured. Results of evaluation are shown in Table 1, Table 2 and Table 3. When the largest width of the coating film adhered to the peeled adhesive tape is 4 mm or less, the SST performance satisfies an acceptable level.

TABLE 1

| | | | Example | | | | | | | | | | | | | | | |
|---|---|---|---|---|---|---|---|---|---|---|---|---|---|---|---|---|---|---|
| | | | 1 | 2 | 3 | 4 | 5 | 6 | 7 | 8 | 9 | 10 | 11 | 12 | 13 | 14 | 15 | 16 |
| Metal surface treatment agent (ppm by mass) | Zr supply source | Zirconium floride | 50 | 75 | 150 | 75 | 75 | 75 | — | 75 | 25 | 100 | 75 | 75 | 100 | 100 | 75 | 50 |
| | | Zirconium nitrate | — | — | — | — | — | — | 75 | — | — | — | — | — | — | — | — | — |
| | Ti supply source | Fluoro-titanic acid | — | — | — | — | — | — | — | — | — | — | — | — | — | — | — | — |
| | Silane coupling agent | Amino group - containing | 400 | 200 | 100 | 200 | 200 | 20 | 200 | — | 200 | 300 | 200 | — | 300 | 300 | 300 | 300 |
| | | Epoxy group - containing | — | — | — | — | — | — | — | 200 | — | — | — | 200 | — | — | — | — |
| | Benzotriazole (solubility: 25 g/L) | | 200 | 200 | 400 | — | — | 100 | 200 | 200 | 100 | — | 200 | 200 | — | — | 200 | 100 |
| | Mercapto-benzothiazole (solubility: 0.9 g/L) | | — | — | — | 200 | — | 100 | — | — | — | 200 | — | — | 200 | 200 | — | 200 |
| | Benzothiazole (solubility: 0.2 g/L) | | — | — | — | — | 200 | — | — | — | 100 | — | — | — | — | — | — | — |
| | Triazole (solubility: >1000 g/L) | | — | — | — | — | — | — | — | — | — | — | — | — | — | — | — | — |
| | Thiazole (solubility: 0.2 g/L) | | — | — | — | — | — | — | — | — | — | — | — | — | — | — | — | — |
| | Carbazole (solubility: <0.1 g/L) | | — | — | — | — | — | — | — | — | — | — | — | — | — | — | — | — |
| | other | Nitric acid | 5000 | 3000 | 2000 | 3000 | 3000 | 3000 | 5000 | 3000 | 5000 | 3000 | 3000 | 3000 | 3000 | 3000 | 3000 | 3000 |
| | | Lactic acid | — | — | — | — | — | — | — | — | — | — | — | — | — | — | — | — |
| | | Matallic ion | — | — | — | — | — | — | — | — | — | Zn 800 | Zn 800 | Al 200 | Ca 200 | — | — | — |
| | (Wb + Wc)/Wa | | 12 | 5.3 | 3.3 | 5.3 | 5.3 | 2.9 | 5.3 | 5.3 | 16.0 | 5.0 | 5.3 | 5.3 | 5.0 | 5.0 | 6.7 | 12.0 |
| Amount of metal surface treatment film | Zr (mg/m$^2$) | | 35 | 41 | 45 | 41 | 44 | 51 | 63 | 66 | 38 | 43 | 60 | 59 | 41 | 43 | 38 | 37 |
| | Ti (mg/m$^2$) | | — | — | — | — | — | — | — | — | — | — | — | — | — | — | — | — |
| | Si (mg/m$^2$) | | 3.1 | 2.8 | 2.6 | 3.1 | 3.3 | 1.8 | 3.8 | 2.2 | 3.5 | 3.1 | 2.1 | 2.1 | 2.8 | 2.8 | 3.6 | 3.4 |
| | C (mg/m$^2$) | | 4.1 | 5.7 | 6.6 | 4.1 | 5.2 | 5.2 | 4.4 | 6.3 | 4.9 | 5.5 | 5.8 | 5.8 | 5.3 | 5.2 | 5.2 | 6.7 |
| | Si/Zr (%) | | 8.9 | 6.8 | 5.8 | 7.6 | 7.5 | 3.5 | 6.0 | 3.3 | 9.2 | 7.2 | 3.5 | 3.6 | 6.8 | 6.5 | 9.5 | 9.2 |
| | Si/Ti (%) | | — | — | — | — | — | — | — | — | — | — | — | — | — | — | — | — |
| Results of evaluation | Bath stability | | P | P | P | P | P | P | P | P | P | P | P | P | P | P | P | P |
| | Smoothness | | A | A | A | A | A | A | A | A | A | A | A | A | A | A | A | A |
| | Th-P property (%) | | 55 | 56 | 60 | 55 | 56 | 56 | 60 | 59 | 58 | 55 | 62 | 60 | 57 | 58 | 55 | 58 |
| | SST performance (mm) | | 2 | 1 | 1 | 2 | 1 | 3 | 2 | 3 | 3 | 2 | 2 | 2 | 2 | 3 | 2 | 2 |

| | | | Examples | | | | | | | | Comparative Example | | | | | | | |
|---|---|---|---|---|---|---|---|---|---|---|---|---|---|---|---|---|---|---|
| | | | 17 | 18 | 19 | 20 | 21 | 22 | 23 | 24 | 1 | 2 | 3 | 4 | 5 | 6 | 7 | 8 |
| Metal surface treatment agent | Zr supply source | Zirconium floride | 450 | 20 | 100 | 100 | 75 | 75 | — | — | 75 | 75 | — | 100 | 100 | 150 | — | 500 |
| | | Zirconium nitrate | — | — | — | — | — | — | — | — | — | — | — | — | — | — | 911 | — |
| | Ti supply | Fluoro-titanic | — | — | — | — | — | — | 75 | 100 | — | — | — | — | — | — | — | — |

TABLE 1-continued

| | | | | | | | | | | | | | | | | | |
|---|---|---|---|---|---|---|---|---|---|---|---|---|---|---|---|---|---|
| (ppm by mass) | source acid | | | | | | | | | | | | | | | | |
| | Silane coupling agent | Amino group - containing | 200 | 200 | 10 | 550 | 200 | 200 | 200 | 300 | — | 200 | 200 | 100 | 100 | 100 | 88 | 200 |
| | | Epoxy group - containing | — | — | — | — | — | — | — | — | — | — | — | — | — | — | — | — |
| | Benzotriazole (solubility: 25 g/L) | | 300 | 200 | 200 | 200 | 40 | 450 | 200 | — | 200 | — | 200 | — | — | — | — | 100 |
| | Mercapto-benzothiazole (solubility: 0.9 g/L) | | — | — | — | — | — | — | — | 200 | — | — | — | — | — | — | — | — |
| | Benzothiazole (solubility: 0.2 g/L) | | — | — | — | — | — | — | — | — | — | — | — | — | — | — | — | — |
| | Triazole (solubility: >1000 g/L) | | — | — | — | — | — | — | — | — | — | — | — | 200 | — | — | — | — |
| | Thiazole (solubility: 0.2 g/L) | | — | — | — | — | — | — | — | — | — | — | — | — | 200 | — | — | — |
| | Carbazole (solubility: <0.1 g/L) | | — | — | — | — | — | — | — | — | — | — | — | — | — | 200 | — | — |
| | other | Nitric acid | 3000 | 5000 | 3000 | 5000 | 3000 | 5000 | 5000 | 3000 | 5000 | 3000 | 3000 | 3000 | 3000 | 3000 | — | 3000 |
| | | Lactic acid | — | — | — | — | — | — | — | — | — | — | — | — | — | — | 4500 | — |
| | | Matallic ion | — | — | — | — | — | — | — | — | — | — | — | — | — | — | Mg 500 | — |
| | (Wb + Wc)/Wa | | 1.1 | 20.0 | 2.1 | 7.5 | 3.2 | 8.7 | 5.3 | 5.0 | 2.7 | 2.7 | ∞ | 1.0 | 1.0 | 0.7 | 0.1 | 0.6 |
| Amount of metal surface treatment film | Zr (mg/m$^2$) | | 58 | 19 | 54 | 24 | 52 | 33 | — | — | 58 | 57 | 0 | 43 | 46 | 52 | 106 | 72 |
| | Ti (mg/m$^2$) | | — | — | — | — | — | — | 65 | 45 | — | — | — | — | — | — | — | — |
| | Si (mg/m$^2$) | | 2.2 | 3.1 | 0.9 | 3.9 | 3.3 | 2.6 | 3.6 | 3 | 0 | 3.5 | 1.3 | 2.6 | 2.6 | 2.8 | 2.1 | 2.3 |
| | C (mg/m$^2$) | | 5.2 | 5.3 | 5.3 | 4.4 | 1.9 | 12.6 | 4.4 | 5.5 | 5.7 | 1.1 | 2.3 | 3.3 | 4.6 | 0.8 | 1.3 | 1.8 |
| | Si/Zr (%) | | 3.8 | 16.3 | 1.7 | 16.3 | 6.3 | 7.9 | — | — | 0.0 | 6.1 | — | 6.0 | 5.7 | 5.4 | 2.0 | 3.2 |
| | Si/Ti (%) | | — | — | — | — | — | — | 5.5 | 6.7 | — | — | — | — | — | — | — | — |
| Results of evaluation | Bath stability | | P | P | P | P | P | P | P | P | P | P | P | P | P | F | P | P |
| | Smoothness | | B | A | A | B | B | A | A | A | B | D | C | D | D | C | C | C |
| | Th-P property (%) | | 44 | 58 | 58 | 52 | 46 | 60 | 55 | 53 | 53 | 32 | 40 | 33 | 31 | 33 | 29 | 33 |
| | SST performance (mm) | | 3 | 4 | 4 | 4 | 2 | 3 | 2 | 2 | 7 | 2 | 8 | 2 | 3 | 2 | 4 | 3 |

TABLE 2

| | | | Example | | | | | | | | | | | | | |
|---|---|---|---|---|---|---|---|---|---|---|---|---|---|---|---|---|
| | | | 25 | 26 | 27 | 28 | 29 | 30 | 31 | 32 | 33 | 34 | 35 | 36 | 37 | 38 |
| Metal surface treatment agent (ppm by mass) | Zr supply source | Zirconium floride | 50 | 75 | 150 | 75 | 75 | 75 | — | 75 | 25 | 100 | 75 | 50 | 450 | 20 |
| | | Zirconium nitrate | — | — | — | — | — | — | 75 | — | — | — | — | — | — | — |
| | Silane coupling agent | Amino group - containing | 400 | 200 | 100 | 200 | 200 | 20 | 200 | — | 200 | 300 | 300 | 300 | 200 | 200 |
| | | Epoxy group - containing | — | — | — | — | — | — | — | 200 | — | — | — | — | — | — |
| | Benzotriazole (solubility: 25 g/L) | | 200 | 200 | 400 | — | — | 100 | 200 | 200 | 100 | — | 200 | 100 | 300 | 200 |
| | Mercaptobenzothiazole (solubility: 0.9 g/L) | | — | — | — | 200 | — | 100 | — | — | — | 200 | — | 200 | — | — |
| | Benzothiazole (solubility: 0.2 g/L) | | — | — | — | — | 200 | — | — | — | 100 | — | — | — | — | — |
| | Triazole (solubility: >1000 g/L) | | — | — | — | — | — | — | — | — | — | — | — | — | — | — |
| | Thiazole (solubility: 0.2 g/L) | | — | — | — | — | — | — | — | — | — | — | — | — | — | — |
| | Carbazole (solubility: <0.1 g/L) | | — | — | — | — | — | — | — | — | — | — | — | — | — | — |
| | other | Nitric acid | 5000 | 3000 | 2000 | 3000 | 3000 | 3000 | 5000 | 3000 | 5000 | 3000 | 3000 | 3000 | 3000 | 5000 |
| | | Lactic acid | — | — | — | — | — | — | — | — | — | — | — | — | — | — |
| | | Matallic ion | — | — | — | — | — | — | — | — | — | — | — | — | — | — |
| | (Wb + Wc)/Wa | | 1.2 | 5.3 | 3.3 | 5.3 | 5.3 | 2.9 | 5.3 | 5.3 | 16.0 | 5.0 | 6.7 | 12.0 | 1.1 | 20.0 |
| Amount of metal surface treatment film | Zr (mg/m$^2$) | | 28 | 33 | 36 | 33 | 35 | 41 | 50 | 53 | 30 | 34 | 30 | 30 | 46 | 15 |
| | Si (mg/m$^2$) | | 2.3 | 2.1 | 2.0 | 2.3 | 2.5 | 1.4 | 2.9 | 1.7 | 2.6 | 2.3 | 2.7 | 2.6 | 1.7 | 2.3 |
| | C (mg/m$^2$) | | 2.9 | 4.0 | 4.6 | 2.9 | 3.6 | 3.6 | 3.1 | 4.4 | 3.4 | 3.9 | 3.6 | 4.7 | 3.6 | 3.7 |
| | Si/Zr (%) | | 8.3 | 6.4 | 5.4 | 7.1 | 7.0 | 3.3 | 5.7 | 3.1 | 8.6 | 6.8 | 8.9 | 8.6 | 3.6 | 15.3 |
| Results of eval- | Bath stability | | P | P | P | P | P | P | P | P | P | P | P | P | P | P |
| | Smothness | | A | A | A | A | A | A | A | A | A | A | A | A | B | A |
| | Th-P property (%) | | 61 | 62 | 66 | 61 | 62 | 62 | 66 | 65 | 64 | 61 | 61 | 64 | 48 | 64 |

TABLE 2-continued

| | | | | | | | | | | | | | | | | |
|---|---|---|---|---|---|---|---|---|---|---|---|---|---|---|---|---|
| uation | SST performance (mm) | | 1 | 1 | 1 | 1 | 1 | 1 | 1 | 1 | 1 | 1 | 1 | 1 | 2 | 2 |
| | | | Examples | | | | | | Comparative Examples | | | | | | | |
| | | | 39 | 40 | 41 | 42 | 9 | 10 | 11 | 12 | 13 | 14 | 15 | 16 | | |
| Metal surface treatment agent (ppm by mass) | Zr supply source | Zirconium floride | 100 | 100 | 75 | 75 | 75 | 75 | — | 100 | 100 | 150 | — | 500 | | |
| | | Zirconium nitrate | — | — | — | — | — | — | — | — | — | — | 911 | — | | |
| | Silane coupling agent | Amino group - containing | 10 | 550 | 200 | 200 | — | 200 | 200 | 100 | 100 | 100 | 88 | 200 | | |
| | | Epoxy group - containing | — | — | — | — | — | — | — | — | — | — | — | — | | |
| | Benzotriazole (solubility: 25 g/L) | | 200 | 200 | 40 | 450 | 200 | — | 200 | — | — | — | — | 100 | | |
| | Mercaptobenzothiazole (solubility: 0.9 g/L) | | — | — | — | — | — | — | — | — | — | — | — | — | | |
| | Benzothiazole (solubility: 0.2 g/L) | | — | — | — | — | — | — | — | — | — | — | — | — | | |
| | Triazole (solubility: >1000 g/L) | | — | — | — | — | — | — | — | 200 | — | — | — | — | | |
| | Thiazole (solubility: 0.2 g/L) | | — | — | — | — | — | — | — | — | 200 | — | — | — | | |
| | Carbazole (solubility: <0.1 g/L) | | — | — | — | — | — | — | — | — | — | 200 | — | — | | |
| | other | Nitric acid | 3000 | 5000 | 3000 | 5000 | 5000 | 3000 | 3000 | 3000 | 3000 | 3000 | — | 3000 | | |
| | | Lactic acid | — | — | — | — | — | — | — | — | — | — | 4500 | — | | |
| | | Matallic ion | — | — | — | — | — | — | — | — | — | — | Mg 500 | — | | |
| | (Wb + Wc)/Wa | | 2.1 | 7.5 | 3.2 | 8.7 | 2.7 | 2.7 | ∞ | 1.0 | 1.0 | 0.7 | 0.1 | 0.6 | | |
| Amount of metal surface treatment film | Zr ($mg/m^2$) | | 43 | 19 | 42 | 26 | 46 | 46 | 0 | 34 | 37 | 42 | 85 | 58 | | |
| | Si ($mg/m^2$) | | 0.7 | 2.9 | 2.5 | 2.0 | 0.0 | 2.5 | 1.0 | 2.0 | 2.0 | 2.1 | 1.6 | 1.7 | | |
| | C ($mg/m^2$) | | 3.7 | 3.1 | 1.3 | 8.8 | 4.0 | 0.6 | 1.6 | 2.3 | 3.2 | 0.6 | 0.9 | 1.3 | | |
| | Si/Zr (%) | | 1.6 | 15.2 | 5.9 | 7.4 | 0.0 | 5.5 | — | 5.7 | 5.3 | 5.0 | 1.9 | 3.0 | | |
| Results of evaluation | Bath stability | | P | P | P | P | P | P | P | P | P | F | P | P | | |
| | Smothness | | A | A | B | A | A | C | C | C | C | C | C | C | | |
| | Th-P property (%) | | 64 | 57 | 51 | 66 | 55 | 35 | 41 | 36 | 34 | 36 | 35 | 39 | | |
| | SST performance (mm) | | 3 | 2 | 1 | 1 | 5 | 1 | 5 | 1 | 2 | 1 | 2 | 2 | | |

TABLE 3

| | | | | | | | | | | | |
|---|---|---|---|---|---|---|---|---|---|---|---|
| | | | Example | | | | | | | | |
| | | | 43 | 44 | 45 | 46 | 47 | 48 | 49 | 50 | 51 | 52 |
| Metal surface treatment agent (ppm by mass) | Zr supply source | Zirconium floride | 50 | 75 | 150 | 75 | 75 | 75 | — | 75 | 25 | 100 |
| | | Zirconium nitrate | — | — | — | — | — | — | 75 | — | — | — |
| | Silane coupling aget | Amino group-containing | 400 | 200 | 100 | 200 | 200 | 20 | 200 | — | 200 | 300 |
| | | Epoxy group-containing | — | — | — | — | — | — | — | 200 | — | — |
| | Benzotriazole (solubility: 25 g/L) | | 200 | 200 | 400 | — | — | 100 | 200 | 200 | 100 | — |
| | Mercaptobenzothiazole (solubility: 0.9 g/L) | | — | — | — | 200 | — | 100 | — | — | — | 200 |
| | Benzothiazole (solubility: 0.2 g/L) | | — | — | — | — | 200 | — | — | — | 100 | — |
| | Triazole (solubility: >1000 g/L) | | — | — | — | — | — | — | — | — | — | — |
| | Thiazole (solubility: 0.2 g/L) | | — | — | — | — | — | — | — | — | — | — |
| | Carbazole (solubility: <0.1 g/L) | | — | — | — | — | — | — | — | — | — | — |
| | other | Nitric acid | 5000 | 3000 | 2000 | 3000 | 3000 | 3000 | 5000 | 3000 | 5000 | 3000 |
| | | Lactic acid | — | — | — | — | — | — | — | — | — | — |
| | | Matallic ion | — | — | — | — | — | — | — | — | — | — |
| | (Wb + Wc)/Wa | | 1.2 | 5.3 | 3.3 | 5.3 | 5.3 | 2.9 | 5.3 | 5.3 | 16.0 | 5.0 |
| Amount of metal surface treatment film | Zr ($mg/m^2$) | | 22 | 21 | 24 | 23 | 22 | 21 | 22 | 23 | 20 | 20 |
| | Si ($mg/m^2$) | | 1.3 | 1.4 | 1.2 | 1.2 | 1.1 | 1.6 | 1.4 | 1.3 | 1.2 | 1.5 |
| | C ($mg/m^2$) | | 2.9 | 2.2 | 2.4 | 2.3 | 2.2 | 2.4 | 2.5 | 2.1 | 2.0 | 2.2 |
| | Si/Zr (%) | | 5.9 | 6.7 | 5.0 | 5.2 | 5.0 | 7.6 | 6.4 | 5.7 | 6.0 | 7.5 |
| Results of evaluation | Bath stability | | P | P | P | P | P | P | P | P | P | P |
| | Smothness | | A | A | A | A | A | A | A | A | A | A |
| | Th-P property (%) | | 60 | 61 | 65 | 60 | 61 | 61 | 65 | 64 | 63 | 60 |
| | SST performance (mm) | | 1 | 1 | 1 | 1 | 1 | 1 | 1 | 1 | 1 | 1 |

As shown in Table 1, Table 2 and Table 3, in all of Examples 1 to 52, the bath stability of the metal surface treatment agent was high, and also the electrodeposition coatability (smoothness and throwing power) was generally acceptable.

From Examples 2, 8, 26, 32, 44 and 47 and Comparative Examples 1 and 9, it was confirmed that the corrosion resistance of the metallic base was poor when the metal surface treatment agent does not contain the silane coupling agent. That is, it was confirmed that when the metal surface treatment agent does not contain one or more coupling agents (B) selected from the group consisting of the silane coupling agents, hydrolysates thereof, and the polymers thereof, the effect of the present invention is not exhibited.

From Examples 2, 7, 26, 31, 44 and 49 and Comparative Examples 3 and 11, it was confirmed that when the metal surface treatment agent does not contain zirconium, the smoothness and the corrosion resistance of the metallic base is poor. That is, it was confirmed that when the metal surface treatment agent does not contain one or more metallic elements (A) selected from the group consisting of zirconium, titanium, and hafnium, the effect of the invention is not exhibited.

From Examples 1 to 52 and Comparative Examples 2, 4 to 7, 10, 12 to 15, it was confirmed that when the metal surface treatment agent does not contain the specific organic compound, the smoothness and the throwing power of the metallic base is poor. That is, it was confirmed that when the metal surface treatment agent does not contain the electrophilic reactive group-containing compound (C) that contains a homocycle and a heterocycle in one molecule and is characterized to have the water solubility of 0.2 to 30 g/L at 20° C., the effect of the invention is not exhibited.

From Examples 1 to 52 and Comparative Examples 3 to 8, and 11 to 16, it was confirmed that when a numerical value obtained by dividing a total content by mass of the coupling agent (B) and the electrophilic reactive group-containing compound (C) by the content of the metallic elements (A) by mass is not larger than 1 and 20 or less 20, the effect of the invention is not exhibited.

INDUSTRIAL APPLICABILITY

The metal surface treatment agent and the metal surface treatment method of the invention may be applicable to the metallic base on which the cationic electrodeposition coating is applied, for example, a vehicle body and components.

EXPLANATION OF REFERENCE NUMERALS

1, 2, 3, 4 . . . Test Sheet
5 . . . Through Hole
10 . . . Box
20 . . . Electrodeposition Coating Vessel
21 . . . Counter Electrode

The invention claimed is:

1. A metal surface treatment agent that is used in a pretreatment of an electrodeposition coating of a metallic base comprising:

one or more metallic elements (A) selected from the group consisting of zirconium, titanium, and hafnium;

one or more coupling agents (B) selected from the group consisting of a silane coupling agent, a hydrolysate thereof and a polymer thereof; and an electrophilic reactive group-containing compound (C), wherein the electrophilic reactive group-containing compound (C) contains a homocycle and a heterocycle in one molecule, and has a water solubility of 0.2 to 30 g/L at 20° C., and when a content of the metallic element (A) by mass is represented by Wa, a content of the coupling agent (B) by mass is represented by Wb, and a content of the electrophilic reactive group-containing compound (C) by mass is represented by Wc, a relationship of the following formula (1) is satisfied:

$$1<(Wb+Wc)/Wa\leq 20 \quad (1).$$

2. The metal surface treatment agent according to claim 1, wherein the electrophilic reactive group-containing compound (C) is one or more compounds selected from the group consisting of a thiazole system compound, a triazole system compound, a pyrazole system compound, and an imidazole system compound.

3. The metal surface treatment agent according to claim 1, wherein a content of the metallic element (A) is 25 to 400 ppm by mass, a content of the coupling agent (B) is 20 to 500 ppm by mass, and a content of the electrophilic reactive group-containing compound (C) is 50 to 400 ppm by mass.

4. The metal surface treatment agent according to claim 1, wherein the coupling agent (B) is one or more coupling agents selected from the group consisting of an amino group-containing silane coupling agent, an epoxy group-containing silane coupling agent, a hydrolysate of the amino group-containing silane coupling agent, a hydrolysate of the epoxy group-containing silane coupling agent, a polymer of the amino group-containing silane coupling agent and a polymer of the epoxy group-containing silane coupling agent.

5. The metal surface treatment agent according to claim 1, wherein the pH of the metal surface treatment agent is from 3 to 6.

6. The metal surface treatment agent according to claim 1, wherein the metallic base contains one or more metals selected from the group consisting of zinc, iron and aluminum.

7. A surface treatment method in which a surface treatment of a metallic base containing one or more metals selected from the group consisting of zinc, iron and aluminum is performed prior to the electrodeposition coating, comprising:

surface treating the metallic base utilizing the metal surface treating agent according to claim 1, and washing the surface-treated metallic base with water.

8. A metallic base on which a metal surface treatment film obtained according to the metal surface treatment method according to claim 7 is formed.

* * * * *